US012760666B2

(12) United States Patent
Lahr

(10) Patent No.: US 12,760,666 B2
(45) Date of Patent: Oct. 13, 2026

(54) VALVE BRIDGE FOR A VALVE TRAIN OF AN INTERNAL COMBUSTION ENGINE, IN PARTICULAR OF A MOTOR VEHICLE, VALVE TRAIN FOR AN INTERNAL COMBUSTION ENGINE, IN PARTICULAR OF A MOTOR VEHICLE, AND INTERNAL COMBUSTION ENGINE

(71) Applicant: Daimler Truck AG, Leinfelden-Echterdingen (DE)

(72) Inventor: Matthias Lahr, Schwaebisch Gmuend (DE)

(73) Assignee: Daimler Truck AG, Leinfelden-Echterdingen (DE)

( * ) Notice: Subject to any disclaimer, the term of this patent is extended or adjusted under 35 U.S.C. 154(b) by 22 days.

(21) Appl. No.: 18/547,630

(22) PCT Filed: Feb. 17, 2022

(86) PCT No.: PCT/EP2022/053863
§ 371 (c)(1),
(2) Date: Aug. 23, 2023

(87) PCT Pub. No.: WO2022/179918
PCT Pub. Date: Sep. 1, 2022

(65) Prior Publication Data

US 2024/0141809 A1 May 2, 2024

(30) Foreign Application Priority Data

Feb. 24, 2021 (DE) ..... 10 2021 000 982.7

(51) Int. Cl.
*F01L 1/26* (2006.01)
*F01L 1/18* (2006.01)
(Continued)

(52) U.S. Cl.
CPC ..... *F01L 1/26* (2013.01); *F01L 1/181* (2013.01); *F01L 1/46* (2013.01); *F01L 13/065* (2013.01); *F01L 2800/17* (2013.01)

(58) Field of Classification Search
CPC ..... F01L 1/181; F01L 1/26; F01L 1/46; F01L 13/06; F01L 2800/17
(Continued)

(56) References Cited

U.S. PATENT DOCUMENTS 6,234,143 B1 * 5/2001 Bartel ..... F02D 13/04 123/321
10,669,900 B2 6/2020 Zurk et al.
(Continued)

FOREIGN PATENT DOCUMENTS

AT 518933 B1 7/2018
CN 102032013 A 4/2011
(Continued)

OTHER PUBLICATIONS

PCT/EP2022/053863, International Search Report dated May 27, 2022 (Three (3) pages).
(Continued)

*Primary Examiner* — Phutthiwat Wongwian
(74) *Attorney, Agent, or Firm* — Crowell & Moring LLP

(57) ABSTRACT

A valve bridge for a valve train of an engine includes a bridge operating region via which the valve bridge can be operated by a first rocker arm and is movable translationally in a first operating direction, a first valve operating region via which a first gas exchange valve of the engine can be operated, and a second valve operating region via which a second gas exchange valve of the engine can be operated. The first valve operating region has a through opening continuous along the first operating direction, a first longitudinal region in which the through opening is completely
(Continued)

continuously closed in its peripheral direction, and a second longitudinal region directly connected to the first longitudinal region in the first operating direction and in which the through opening is open along its peripheral direction at a first location in a first opening direction perpendicular to the first operating direction.

8 Claims, 5 Drawing Sheets

(51) Int. Cl.
*F01L 1/46* (2006.01)
*F01L 13/06* (2006.01)

(58) Field of Classification Search
USPC ..... 123/90.4
See application file for complete search history.

(56) References Cited

U.S. PATENT DOCUMENTS

| | | | | |
|---|---|---|---|---|
| 2011/0079196 | A1 | 4/2011 | Kraft et al. | |
| 2015/0159521 | A1 | 6/2015 | Baltrucki et al. | |
| 2018/0058271 | A1* | 3/2018 | Baltrucki | F01L 1/18 |
| 2019/0242278 | A1* | 8/2019 | Zurk | F01L 3/22 |
| 2020/0018243 | A1 | 1/2020 | Baltrucki et al. | |
| 2020/0141335 | A1 | 5/2020 | Groth et al. | |
| 2020/0208543 | A1* | 7/2020 | Turuvekere Gurudatt | F01L 1/18 |
| 2020/0263571 | A1* | 8/2020 | Benn | F01L 1/267 |
| 2020/0340372 | A1* | 10/2020 | Lahr | F01L 1/047 |

FOREIGN PATENT DOCUMENTS

| | | | | |
|---|---|---|---|---|
| CN | 102032013 | B | 7/2013 | |
| CN | 105579674 | A | 5/2016 | |
| CN | 205677685 | U | 11/2016 | |
| CN | 109642478 | A | 4/2019 | |
| CN | 111212962 | A | 5/2020 | |
| DE | 10 2006 019 254 | B4 | 10/2007 | |
| DE | 10 2009 048 143 | A1 | 4/2011 | |
| DE | 10 2019 005 187 | A1 | 1/2021 | |
| WO | WO-2015177127 | A1 * | 11/2015 | F01L 1/181 |
| WO | WO-2019072523 | A1 * | 4/2019 | F01L 1/047 |

OTHER PUBLICATIONS

German-language German Office Action issued in German application No. 10 2021 000 982.7 dated Nov. 8, 2021 (Eight (8) pages).
International Preliminary Report on Patentability (PCT/IB/373) and Written Opinion (PCT/ISA/237) issued in PCT Application No. PCT/EP2022/053863, dated Aug. 29, 2023, with English translation (13 pages).
German-language Office Action issued in German Application No. 10 2021 000 982.7 dated Dec. 11, 2024 (6 pages).
German-language Office Action issued in German Application No. 10 2021 000 982.7 dated May 19, 2025 (5 pages).
Chinese-language Office Action issued in Chinese Application No. 202280016636.8 dated Nov. 14, 2025 with partial English translation (11 pages).

* cited by examiner

VALVE BRIDGE FOR A VALVE TRAIN OF AN INTERNAL COMBUSTION ENGINE, IN PARTICULAR OF A MOTOR VEHICLE, VALVE TRAIN FOR AN INTERNAL COMBUSTION ENGINE, IN PARTICULAR OF A MOTOR VEHICLE, AND INTERNAL COMBUSTION ENGINE

BACKGROUND AND SUMMARY OF THE INVENTION

The invention relates to a valve bridge for a valve train of an internal combustion engine, in particular of a motor vehicle. The invention further relates to a valve train for an internal combustion engine, in particular of a motor vehicle. The invention also relates to an internal combustion engine.

US 2018/0058271 A1 discloses a system for operating at least one of two or more engine valves in an internal combustion engine. The system comprises a rocker arm for operating the two or more engine valves. The system additionally comprises a valve bridge that engages with the rocker arm to transfer a movement from the rocker arm to the two or more engine valves.

The object of the present invention is to create a valve bridge for a valve train of an internal combustion engine and a valve train for an internal combustion engine, such that the internal combustion engine can be particularly easily maintained and/or repaired.

A first aspect of the invention relates to a valve bridge for a valve train of an internal combustion engine preferably designed as a reciprocating piston engine, in particular of a motor vehicle. This means that the motor vehicle preferably designed as a motor car, in particular as a commercial vehicle, in its fully produced state comprises the internal combustion engine and can be driven by means of the internal combustion engine. In its fully produced state, the internal combustion engine comprises the valve train, which in turn comprises the valve bridge. The valve bridge has a bridge operating region, via which the valve bridge can be operated by means of a first rocker arm of the valve train and can thus be moved translationally in a first operating direction. The bridge operating region is thus designed to engage with the first rocker arm. The first rocker arm is for example pivotably mounted on a rocker arm axle and can thus be pivoted around a pivot axis relative to the rocker arm axle. For example, the first rocker arm can be operated by means of a cam of a camshaft and can thus be pivoted around the pivot axis relative to the rocker arm axle. By pivoting the first rocker arm around the pivot axis relative to the rocker arm axle, the valve bridge can be operated via the bridge operating region by means of the first rocker arm. The bridge operating region is thus designed, for example, to transform a movement, in particular the pivoting, of the first rocker arm into a movement of the valve bridge in the operating direction relative to the rocker arm axle. In other words, the bridge operating region is designed, for example, to transfer a movement, in particular the pivoting, of the first rocker arm to the valve bridge, whereby the valve bridge is or can be moved translationally in the first operating direction relative to the rocker arm axle.

The valve bridge additionally has a first valve operating region, via which a first gas exchange valve of the internal combustion engine can be operated by means of the valve bridge by operating the valve bridge. The valve bridge additionally has a second valve operating region, which is spaced apart from the first valve operating region, for example in particular in the longitudinal extension direction of the valve bridge. Via the second valve operating region, a second gas exchange valve of the internal combustion engine, in particular provided in addition to the first gas exchange valve, can be operated by means of the valve bridge by operating the valve bridge. Operating the respective gas exchange valve can in particular be understood to mean that when or by operating the respective gas exchange valve, the gas exchange valve is moved out of a closed position into an open position, in particular relative to the rocker arm axle and/or translationally. For example, the respective gas exchange valve is or can be moved, in a direction of movement running in parallel with the first operating direction, from the closed position into the open position. In particular, the respective gas exchange valve can be an exhaust valve. It is further preferably provided that the bridge operating region is spaced apart from the respective valve operating region. The valve operating regions and the bridge operating region are thus preferably regions of the valve bridge spaced apart from one another, and in particular different from one another, wherein the bridge operating region is arranged between the valve operating regions.

To guarantee that maintenance and/or repair of the internal combustion engine can be carried out particularly easily, and thus in a time- and cost-efficient manner, it is provided according to the invention that at least one of the valve operating regions has a through opening that is continuous and in particular preferably open-ended per se, i.e., when considered in isolation, in the operating direction. The through opening has a first longitudinal region in which the through opening is completely continuously closed along its peripheral direction in particular running around the first operating direction. This should in particular be understood to mean that the through opening is delimited in the first longitudinal region completely continuously, and thus without interruption, along the peripheral direction by a wall of the valve bridge. For example, the through opening is thus closed or delimited, and thus not actually open, in the first longitudinal region in a plane running perpendicular to the first operating direction and/or in every direction running perpendicular to the operating direction.

The through opening additionally has a second longitudinal region which is directly connected to the first longitudinal region in the operating direction. The feature that the second longitudinal region is directly connected to the first longitudinal region in the first operating direction should be understood to mean that no other, further longitudinal region of the through opening is arranged between longitudinal regions along the first operating direction, and instead, the second longitudinal region directly follows the first longitudinal region. In the second longitudinal region, the through opening is open along its peripheral direction running around the operating direction at, in particular at least or exactly, one first location in a direction running perpendicular to the opening direction and also described as a first opening direction.

It has been found that by using the valve bridge according to the invention, and in particular by using the two longitudinal regions, on the one hand, the internal combustion engine can be maintained and/or repaired, also described as a servicing, particularly advantageously, as, for example, the valve bridge does not need to be completely dismounted to reach e.g., a fixing, in particular screw connection, of an injector arranged under the valve bridge In particular, by using the valve bridge according to the invention, it can be avoided that the valve train has to be completely dismounted to create access to the fixing of the injector. The valve bridge can further be dismounted in a particularly simple, and thus time- and cost-efficient manner to reach the fixing of the injector, wherein, however, the remaining valve train does not need to be dismounted unnecessarily.

The respective gas exchange valve is assigned to a gas duct, designed as an exhaust duct or intake duct, of a cylinder head of the internal combustion engine, wherein in its respective closed position, the respective gas exchange valve closes the respectively assigned gas duct. In the respective open position of the respective gas exchange valve, the respective gas exchange valve releases the respectively assigned gas duct. The gas ducts are assigned to the same cylinder of the internal combustion engine. In the respective open position of the respective gas exchange valve, a gas for example comprising at least air can thus flow into the cylinder via the respectively assigned gas duct (intake duct), for example, and/or in the respective open position of the respective gas exchange valve, a gas for example first received in the cylinder can flow out of the cylinder via the respectively assigned gas duct (exhaust duct). The previously specified injector is designed to introduce a, for example liquid, fuel into the cylinder, in particular to inject the fuel directly into the cylinder. The injector is fixed to the cylinder head by means of the previously specified fixing, for example. In the complete and fully produced state of the internal combustion engine, the fixing is overlapped or covered by the completely and fully mounted valve bridge, for example, such that the fixing is not accessible by a person who would like to maintain or repair the internal combustion engine. In conventional internal combustion engines, the valve train or at least the valve bridge needs to be disassembled, i.e., dismounted, in a time-consuming and high-cost manner and optionally completely in order to reach the fixing. Consequently, the injector can, for example, be removed from the cylinder head and, for example, be maintained, repaired or exchanged.

Such complete dismounting of the valve bridge or of the valve train can now be avoided by using the valve bridge according to the invention, wherein sufficient accessibility to the fixing can still be created in a particularly simple and cost-efficient manner.

On the other hand, a particularly high and, in comparison with conventional solutions, substantially greater rigidity of the valve bridge, in particular of the at least one valve operating region, can be created, as the through opening or the at least one valve operating region is not fork-shaped and thus is not for instance open in the first opening direction over its entire extension running along the operating direction, and instead the through opening or the at least one valve operating region is completely continuously closed in the first longitudinal region along the peripheral direction. In comparison with a fork-shaped embodiment of the at least one valve operating region, an at least partially ring-shaped collar in the form of a bracket is thus created in the first longitudinal region, which makes the valve bridge substantially more stable and rigid, in particular in the first valve operating region, in comparison with a fork-shaped embodiment. The valve bridge can simultaneously be partially or else completely, and thus particularly easily removed, i.e., dismounted, so as to make the fixing sufficiently accessible without having to dismount the entire valve train. In particular, a removal of the rocker arm axle and of the first rocker arm can be avoided so as to make the fixing—for example formed as a screw connection—of the injector sufficiently accessible. Consequently, the internal combustion engine can be maintained or repaired in a particularly time- and cost-efficient manner. Additionally, the probability of errors or damage occurring when removing or installing components while maintaining or repairing the internal combustion engine can be kept particularly low. Additionally, the valve bridge can be constructed such that it is possible to particularly advantageously pre-mount the valve bridge using an optionally provided valve cap. The valve cap and the valve bridge can thus form a coherent assembled unit or in particular one that is constructed independently of the rest of the valve train, which can be mounted as a whole, and thus in a time- and cost-efficient manner. Consequently, the internal combustion engine can be mounted or produced in a time- and cost-efficient manner.

To be able to maintain and/or repair the internal combustion engine in a particularly simple manner, it is provided in an embodiment of the invention that the second valve operating region has a groove that is open along its peripheral direction running around the operating direction at in particular at least or exactly one second location in a direction running perpendicular to the operating direction and for example also described as a second opening direction. The second opening direction is preferably opposite to the first opening direction, or the second opening direction runs at an angle to the first opening direction.

A further embodiment is characterized in that the groove is completely closed in a second operating direction opposite to the first operating direction. Thus, on the one hand, the internal combustion engine can be particularly easily maintained or repaired, as the valve bridge can be dismounted in a particularly simple manner to make the fixing sufficiently accessible. On the other hand, a particularly high rigidity of the valve bridge can be guaranteed.

To be able to mount and dismount the valve bridge particularly easily, it is provided in a further embodiment of the invention that the valve bridge is designed as one part.

A second aspect of the invention relates to a valve train for an internal combustion engine. The valve train has a first gas exchange valve and a second gas exchange valve, which is arranged in addition to the first gas exchange valve and is preferably spaced apart from the first gas exchange valve. The valve train additionally comprises a first rocker arm and a valve bridge shared by the gas exchange valves, in particular according to the first aspect of the invention. The gas exchange valves can be operated by means of the first rocker arm via the valve bridge, and can thus be moved translationally in a first movement direction from the closed position into the open position, in particular relative to a rocker arm axle, on which the first rocker arm can be mounted pivotably around a pivot axis relative to the rocker arm axle. The valve bridge is thus designed to transfer a movement, in particular a pivoting, of the first rocker arm to the gas exchange valves such that the gas exchange valves can be operated by means of the first rocker arm by way of the valve bridge by the first rocker arm being pivoted around the pivot axis relative to the rocker arm axle.

The valve bridge has a bridge operating region, via which the valve bridge can be operated by means of the first rocker arm and can thus be moved translationally in an operating direction running in parallel with the first movement direction. The valve bridge additionally has a first valve operating region, via which the first gas exchange valve can be operated by means of the valve bridge by operating the valve bridge. The valve bridge additionally has a second valve operating region, via which the second gas exchange valve can be operated by means of the valve bridge by operating the valve bridge.

So that the internal combustion engine can be maintained and/or repaired particularly easily, it is provided in the second aspect of the invention that at least one of the valve operating regions has a through opening which is continuous along the first operating direction. The through opening additionally has a first longitudinal region, in which the through opening is completely continuously closed along its peripheral direction running around the first operating direction. The through opening further has a second longitudinal region which is directly connected to the first longitudinal region in the first operating direction and in which the through opening is open along its peripheral direction at in particular at least or exactly one first location in a direction running perpendicular to the operating direction. Advantages and advantageous embodiments of the first aspect of the invention should be seen as advantages and advantageous embodiments of the second aspect of the invention and vice versa.

In a particularly advantageous embodiment of the invention, the valve train has a valve cap which is designed separately from the gas exchange valves, separately from the first rocker arm and separately from the valve bridge and via which only the first gas exchange valve can be operated by means of a further, second rocker arm of the valve train. It is preferably provided that the valve train has the further, second rocker arm in addition to the first rocker arm. The second rocker arm is, for example, pivotably mounted on the rocker arm axle, and can be pivoted around the pivot axis relative to the rocker arm axle. The two rocker arms can in particular be pivoted around the pivot axis relative to one another and relative to the rocker arm axle. It is in particular provided that the first gas exchange valve can be operated via the valve cap by means of the second rocker arm, while the valve bridge and/or the second gas exchange valve are not operated by the second rocker arm. Thus, for example, the second rocker arm is a so-called brake rocker arm, by means of which the second gas exchange valve preferably designed as an exhaust valve can be operated without the first gas exchange valve being operated in order to implement an engine braking operation and thus an engine brake of the internal combustion preferably designed as a decompression brake.

It has proved advantageous for particularly easily maintaining or repairing the internal combustion engine if the valve cap passes through the two longitudinal regions and thus the through opening along the operating direction, in particular completely. The valve cap thus passes through the first longitudinal region and the second longitudinal region.

A further embodiment is characterized in that the valve bridge and the valve cap form an assembled unit which, considered on its own, has been assembled and is thus able to be mounted as a whole, in particular during the initial assembly of the internal combustion engine, in which the valve cap is held on the valve bridge independently of the gas exchange valves and independently of the two rocker arms. The valve bridge and the valve cap can thus be pre-mounted to form the assembled unit so that, for example, forgetting the valve cap during initial assembly of the internal combustion engine can be prevented, whereby process safety increases in a particularly simple, time- and cost-efficient manner.

So that a sufficient accessibility to the fixing of the injector can be implemented in a particularly simple manner without having to excessively or completely dismount the valve train, it is provided in a further embodiment of the invention that the open first location is covered or overlapped in a second operating direction opposite to the first operating direction by a collar of the valve bridge arranged in the first longitudinal region. As described above, the collar is an at least partially ring-shaped collar in the form of a bracket, such that the through opening is completely closed in the first longitudinal region in the peripheral direction of the through opening. The collar thus has an extension running along the first operating direction. The valve bridge can additionally be shifted in the direction opposite to the operating direction relative to the gas exchange valves, relative to the valve cap and relative to the two rocker arms into a dismounting position. In the dismounting position, the second gas exchange valve is arranged completely outside of the second valve operating region, in particular completely outside of the previously specified groove of the second valve operating region in the idle state of the first rocker arm and of the second rocker arm (brake rocker arm). Additionally, in the dismounting position and in the idle state of the rocker arm and of the second rocker arm (brake rocker arm), a spacing running along the first operating direction between the second rocker arm (brake rocker arm) and the valve cap remaining on the first gas exchange valve when shifting the valve bridge into the dismounting position is larger than the extension of the collar. The valve bridge can thus be dismounted in a particularly simple, time- and cost-efficient manner so as to make the fixing of the injector sufficiently accessible without having to excessively or completely dismount the valve train. It is in particular sufficient to dismount the previously specified assembled unit so as to make the fixing sufficiently accessible. As the assembled unit can be mounted and dismounted as a whole, the assembled unit per se can be easily, time- and cost-efficiently dismounted and then mounted again.

A third aspect of the invention relates to an internal combustion engine, preferably designed as a reciprocating piston engine, for a motor vehicle, wherein, according to the third aspect of the invention, the internal combustion engine has at least one valve train according to the second aspect of the invention. Advantages and advantageous embodiments of the first aspect of the invention and of the second aspect of the invention should be seen as advantages and advantageous embodiments of the third aspect of the invention and vice versa.

Further advantages, features and details of the invention result from the following description of preferred exemplary embodiments and with reference to the drawings. The features and combinations of features specified previously in the description and the features and combinations of features specified in the following description of figures and/or shown in the figures alone can be used not only in the respectively specified combinations, but also in other combinations or in isolation without leaving the scope of the invention.

DETAILED DESCRIPTION OF THE DRAWINGS

Identical or functionally identical elements are provided with the same reference signs in the figures.

Figure 1:
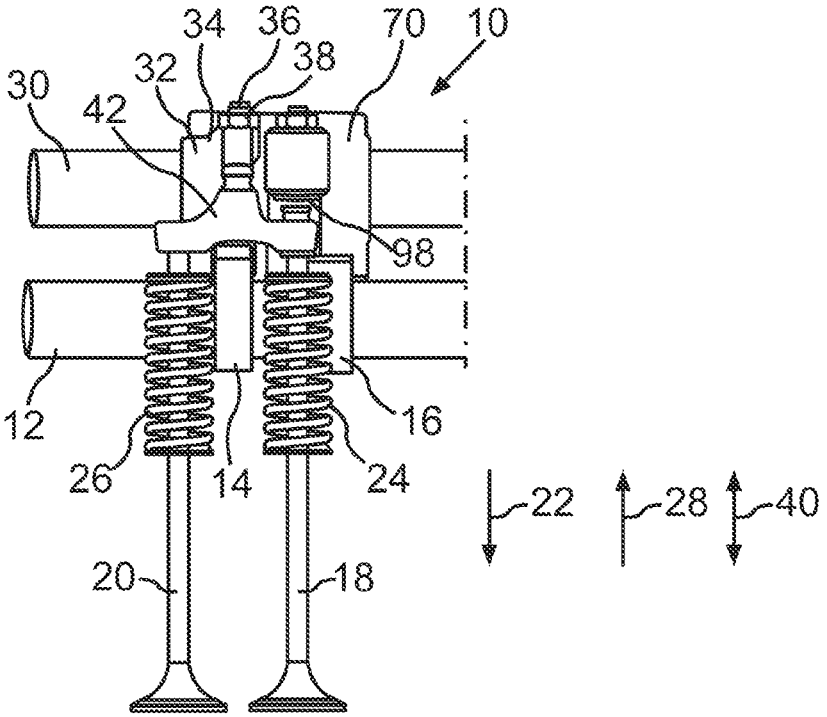
FIG. 1 shows a section of a schematic front view of a valve train according to the invention.

FIG. 1 shows a schematic front view of a valve train 10 for an internal combustion engine, designed as a reciprocating piston engine, of a motor vehicle. The motor vehicle is preferably designed as a motor car, in particular as a commercial vehicle and comprises the internal combustion engine also described as a combustion engine in its fully produced state, by means of which the motor vehicle can be driven. The internal combustion engine (not depicted in more detail) has at least one cylinder, in which combustion processes take place during a fired operation of the internal combustion engine. The cylinder is for example formed by a crankcase of the internal combustion engine. The internal combustion engine additionally comprises a cylinder head designed separately from the crankcase and connected to the crankcase, forming a combustion chamber roof that is assigned to the cylinder. The cylinder and the combustion chamber roof respectively partially form a combustion chamber. The combustion chamber is also partially formed by a piston that can be arranged such that it can be moved translationally in the cylinder.

The valve train 10 is depicted in an exemplary form for a cylinder and has a camshaft 12 for example rotatably mounted on the cylinder head and thus around a rotation axis relative to the cylinder head, the camshaft having a first cam 14 and a second cam 16. The valve train 10 additionally comprises a first gas exchange valve 18 and a second gas exchange valve 20, which are assigned to the same cylinder and thus share the aforementioned cylinder. The gas exchange valves 18 and 20 are for example designed as exhaust valves. A gas duct, for example formed or delimited by the cylinder head, is respectively assigned to the respective gas exchange valve 18 or 20, the gas duct for example being an exhaust duct. The respective gas exchange valve 18 or 20 can be moved translationally between at least one closed position and at least one open position relative to the cylinder head. In the respective closed position, the respective gas exchange valve 18 or 20 closes the respectively assigned exhaust duct. In the respective open position, however, the respective gas exchange valve 18 or 20 releases the respectively assigned exhaust duct, such that a gas first located in the cylinder can flow out of the cylinder via the released exhaust duct. The respective gas exchange valve 18 or 20 can be moved translationally in a first movement direction depicted by an arrow 22 in FIG. 1 from the respective closed position into the respective open position relative to the cylinder head. A spring 24 or 26 also described as a return spring is assigned to the respective gas exchange valve 18 or 20. If the respective gas exchange valve 18 or 20 is moved out of the respective closed position into the respective open position, and thus in the first movement direction 22 relative to the cylinder head, the respective spring 24 or 26 is tensioned, in particular compressed. The respective spring 24 or 26 consequently provides a spring force that acts in a second movement direction opposite to the first movement direction 22 and depicted by an arrow 28 in FIG. 1. The respective gas exchange valve 18 or 20 can be translationally moved in the second movement direction 28 from the respective open position into the respective closed position by means of the respective spring force, and in particular is to be held in the respective closed position.

The valve train 10 has a rocker arm axle 30 and a first rocker arm 32, which is also described as an exhaust rocker arm. The first rocker arm 32 comprises a base body 34, an adjusting element 36 presently designed as an adjusting screw and a counter-element 38 presently designed as a counter nut. The adjusting element 36 can for example be moved translationally relative to the base body 34 along an adjustment direction 40 depicted in FIG. 1 by a double arrow 40 and running in parallel to the first movement direction 22 and in parallel to the second movement direction 28. The adjusting element 36 can thus be moved along the adjustment direction 40 relative to the base body 34 into different locations or positions, in which the adjusting element 36 is or can be fixed by means of the counter-element 38 relative to the base body 34. The adjusting element 36 is for example designed as an adjusting screw and screwed into the base body 34. If the adjusting screw 36 is for example rotated in a first rotation direction relative to the base body 34, then the adjusting screw 36 is for example moved translationally in the first movement direction 22 relative to the base body 34. If, for example, the adjusting screw 36 is rotated relative to the base body 34 in a second rotation direction opposite to the first rotation direction, then the adjusting screw is for example moved translationally relative to the base body 34 in the second movement direction 28 opposite to the first movement direction 22. The counter-element 38 (counter nut) serves for example to secure the adjusting screw 36 against rotations occurring relative to the base body 34 and thus against translational displacement occurring relative to the base body 34 in the adjustment direction 40 and relative to the base body 34. A valve clearance known per se can be adjusted with the adjusting element 36.

The valve train 10 also has a valve bridge 42 shared by the gas exchange valves 18 and 20 and preferably designed as one part, wherein FIGS. 5 to 9 depict a first embodiment and FIGS. 10 to 14 depict a second embodiment of the valve bridge 42. The gas exchange valves 18 and 20 can be operated via the valve bridge 42 by means of the first cam 14 via the first rocker arm 32 and can thus be moved translationally in the first movement direction 22 and second movement direction 28 relative to the cylinder head and relative to the rocker arm axle 30.

Figure 5:
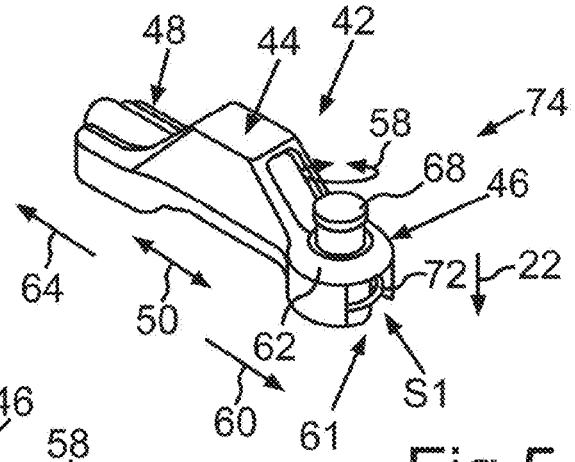
FIG. 5 shows a schematic perspective view of a first embodiment of a valve bridge of the valve train.
Figure 6:
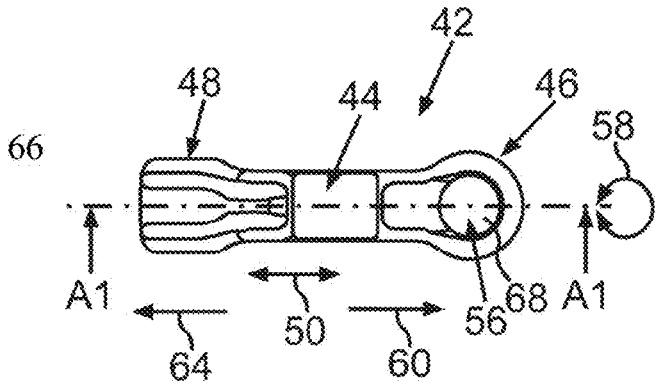
FIG. 6 shows a schematic aerial view of the valve bridge according to FIG. 5.
Figure 9:
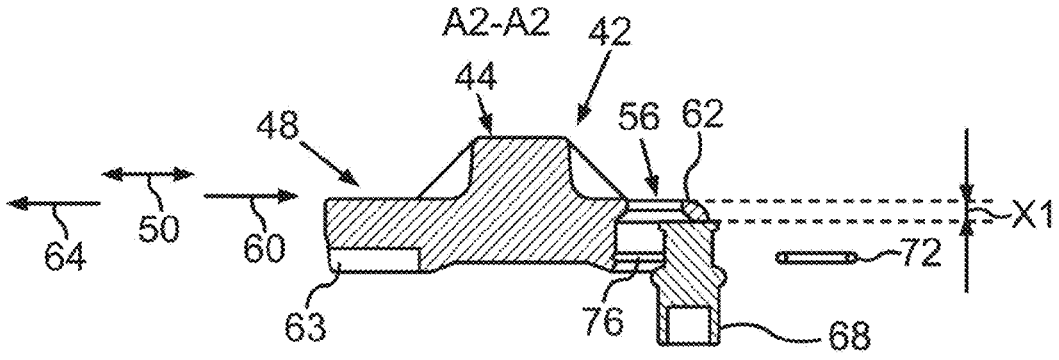
FIG. 9 shows a schematic sectional view of the valve bridge according to FIG. 8 along a section line A2-A2 shown in FIG. 8.

As can be seen particularly clearly when viewing FIG. 5 together with FIG. 9, the valve bridge 42 has a bridge operating region 44, via which the valve bridge 42 can be operated by means of the first rocker arm 32 and can thus be moved translationally in a direction in parallel with the movement directions 22, 28 relative to the cylinder head and relative to the rocker arm axle 30. The valve bridge 42 further has a first valve operating region 46 that is spaced apart from the bridge operating region 44, in particular in a longitudinal extension direction 50 of the valve bridge 42. The first gas exchange valve 18 can be operated by means of the valve bridge 42 via the first valve operating region 46 by operating the valve bridge 42, and can thus be moved translationally in the first movement direction 22 from the closed position into the open position of the first gas exchange valve 18 relative to the rocker arm axle 30 and relative to the cylinder head.

The valve bridge 42 additionally has a second valve operating region 48, which is spaced apart from the valve operating region 46 and from the bridge operating region 44, in particular in the longitudinal extension direction 50 of the valve bridge 42. The longitudinal extension direction of the valve bridge 42 is depicted by a double arrow 50, wherein the longitudinal extension direction 50 for example runs perpendicular to the movement directions 22, 28 and to the adjustment direction 40. The second gas exchange valve 20 can be operated by means of the valve bridge 42 via the second valve operating region 48 by operating the valve bridge 42, and can thus be moved translationally in the first movement direction 22 from the closed position into the open position of the second gas exchange valve 20 relative to the rocker arm axle 30 and relative to the cylinder head. The longitudinal extension direction 50 thus runs perpendicular to the gas exchange valves 18, 20, whereby the bridge operating region 44 is provided along the longitudinal extension direction 50 between the first valve operating region 46 and the second valve operating region 48 on the valve bridge 42.

Figure 4:
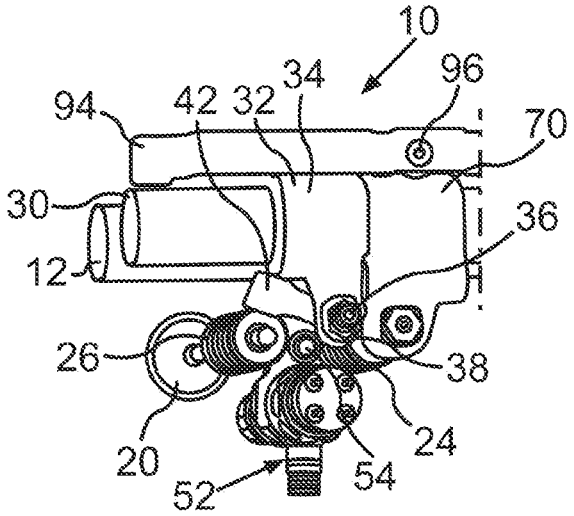
FIG. 4 shows a section of a schematic and perspective aerial view of the valve train.

It can be recognized from FIG. 4 that an injector 52 is also assigned to the cylinder. By means of the injector 52, an in particular liquid fuel can be introduced, in particular directly injected, into the cylinder to operate the internal combustion engine. The injector 52 is fixed to the cylinder head by means of a fixing 54 preferably designed as a screw. As the fixing 54 is for example designed as a screw, the fixing 54 is for example also described as an injector screw.

In the complete and fully produced state of the motor vehicle and thus of the internal combustion engine and in particular of the valve train 10, the fixing 54 is overlapped or covered in particular in the vertical direction of the vehicle and/or upwards in the vertical direction of the internal combustion engine by the valve bridge 42. The fixing 54 is thus not accessible for a person who would like to maintain or repair the internal combustion engine in the complete and fully produced state of the internal combustion engine.

Figure 7:
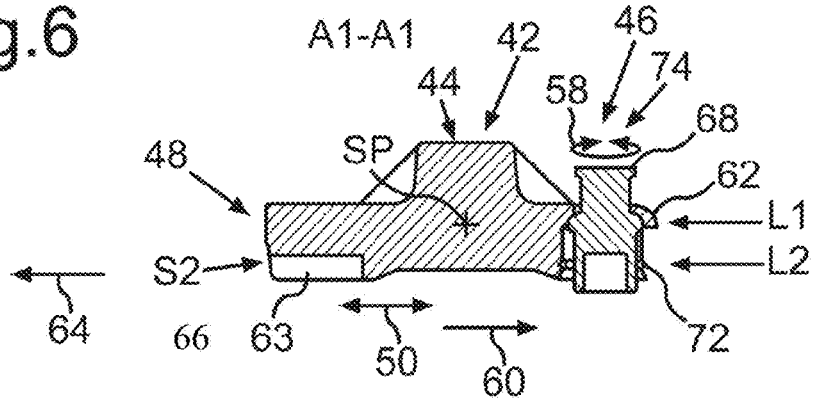
FIG. 7 shows a schematic sectional view of the valve bridge according to FIG. 6 along a section line A1-A1 shown in FIG. 6.
Figure 12:
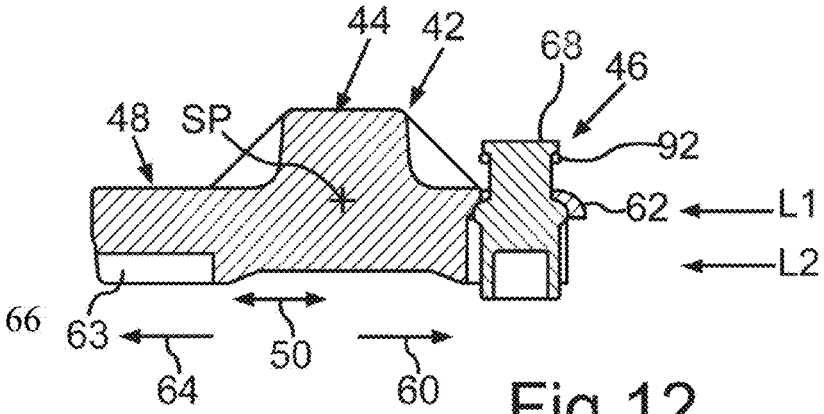
FIG. 12 shows a schematic sectional view of the valve bridge according to FIG. 11 along a section line A3-A3 shown in FIG. 11.
Figure 13:
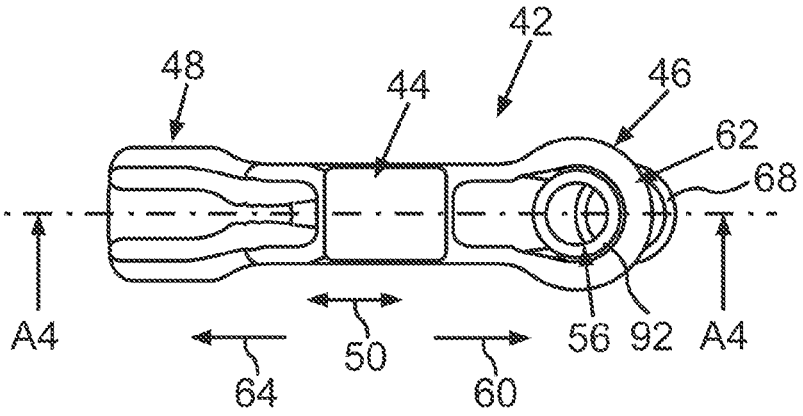
FIG. 13 shows a schematic exploded view in an aerial view of the valve bridge according to the second embodiment.
Figure 14:
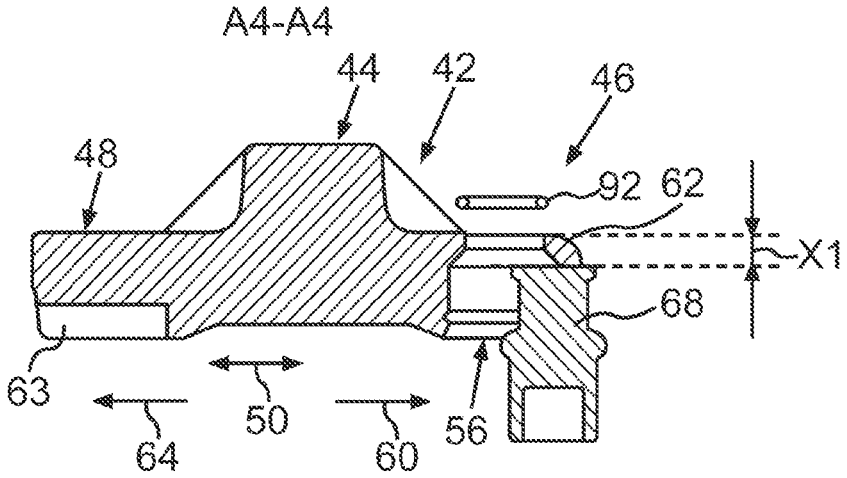
FIG. 14 shows a schematic sectional view of the valve bridge according to FIG. 13 along a section line A4-A4 shown in FIG. 13.

To make the fixing 54 sufficiently accessible in a particularly simple and thus time- and cost-efficient manner, and consequently to be able to maintain and/or repair the internal combustion engine in a particularly simple and thus time- and cost-efficient manner, the first valve operating region 46—as can for example be clearly seen from FIG. 9 and FIG. 14—has a through opening 56 that is continuous along the movement directions 22, 28. The through opening 56 additionally has a first longitudinal region L1 in which the through opening 56 is completely continuous along its peripheral direction for example depicted by a double arrow 58 in FIG. 5 and running around the movement directions 22, 28, and is thus closed without interruption. The through opening 56 additionally has a second longitudinal region L2 directly or immediately connected to the first longitudinal region L1 in the first movement direction 22 (FIGS. 7 and 12). In the second longitudinal region L2, the through opening 56 has a longitudinal opening 61 along its peripheral direction 58 at exactly one location S1 in a direction running perpendicular to the movement directions 22, 28 and for example depicted by an arrow 60 in FIGS. 5 and 10 and also described as a first opening direction. The first opening direction 60 runs in parallel to the longitudinal extension direction 50.

The through opening 56 has a smaller diameter in the first longitudinal region L1 when viewed in the peripheral direction 58 than the second longitudinal region L2. The longitudinal region L1 thus forms a collar 62, on which the second longitudinal region L2 is formed in the first movement direction 22.

The second valve operating region 48 has a groove 63, as can for example be clearly seen from FIG. 7 and FIG. 12. The groove 63 is for example introduced into the second valve operating region 48 of the valve bridge 42 along the longitudinal extension direction 50, perpendicular to the movement directions 22, 28. The groove 63 is completely closed in the second movement direction 28, and thus open for receiving the gas exchange valve 20 in the first movement direction 22. The groove 63 is open at exactly one second location S2 in a second opening direction running perpendicular to the movement directions 22, 28, depicted by an arrow 64. The groove 63 thus has a groove opening 66 at the second location S2. The valve bridge 42 is additionally designed as one part per se.

The valve train 10 has a valve cap 68 designed separately from the gas exchange valves 18 and 20, separately from the first rocker arm 32 and separately from the valve bridge 42 and via which the first gas exchange valve 18 can be operated by means of a second rocker arm 70 provided in addition to the rocker arm 32, while an operation of the second gas exchange valve 20 caused by the second rocker arm 70 ceases. The second rocker arm 70 is pivotably mounted on the rocker arm axle 30 and can thus be pivoted around the previously specified pivot axis relative to the rocker arm axle 30 and relative to the first rocker arm 32. The second rocker arm 70 is operated by the second cam 16, whereby only the first gas exchange valve 18 can be moved translationally in the first movement direction 22 and the second movement direction 28 relative to the cylinder head and relative to the rocker arm axle 30. The second rocker arm 70 is a so-called brake rocker arm, by means of which the gas exchange valve 18 can be operated such that an engine braking operation, and thus an engine brake, designed as a decompression brake, of the internal combustion engine can be implemented. The valve cap 68 completely passes through the longitudinal regions L1 and L2 along the operating directions 22, 28.

Figure 8:
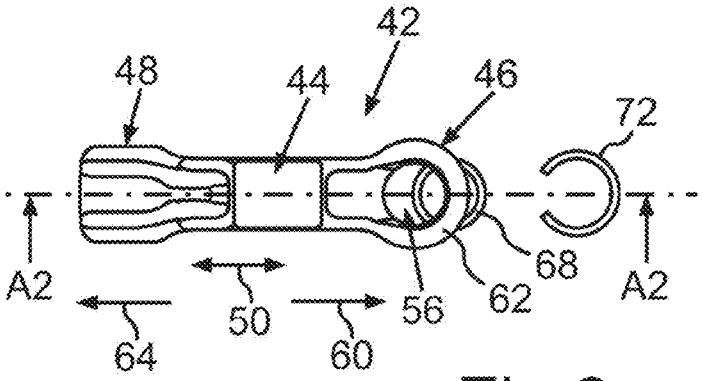
FIG. 8 shows a schematic exploded view in an aerial view of the valve bridge according to the first embodiment.

It can be particularly clearly seen from FIGS. 5 and 7 that, in the first embodiment of the valve bridge 42, the valve cap 68 designed separately from the valve bridge 42 is held on the valve bridge 42 by means of at least or exactly one first fixing element 72, such that the valve bridge 42 and the valve cap 68 form an assembled unit 74 which, considered on its own, has been assembled and is thus able to be mounted and dismounted as a whole. In the assembled unit 74, the valve cap 68 is held on the valve bridge 42 independently of the gas exchange valves 18 and 20 and independently of the first rocker arm 32 and independently of the second rocker arm 70. In FIGS. 8 and 9, it can be clearly seen that the first fixing element 72 is designed separately from the valve cap 68 and separately from the valve bridge 42. In the first embodiment, the first fixing element 72 is an open wire ring, in particular a clamping ring, for example formed from a metal material. In the assembled state of the assembled unit 74, it can be particularly clearly seen from FIGS. 5 and 7 that the fixing element 72 is received in the through opening 56 in the second longitudinal region L2 in a peripheral groove 76. As can be seen from FIG. 5, the wire ring 72 runs through the longitudinal opening 61. The wire ring 72 can thus be dismounted when the valve train 10 is completely mounted, for example by means of a suitable tool. The valve cap 68 is received in the fixing element 72 such that it can shift in the movement directions 22, 28.

Figure 15:
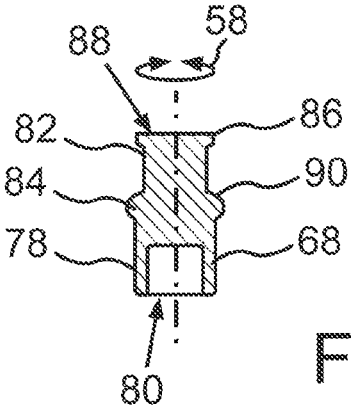
FIG. 15 shows a schematic sectional view of a valve cap.

FIG. 15 depicts the valve cap 68 which is used for the first embodiment according to FIGS. 5 to 9 and for the second embodiment according to FIGS. 10 to 14. In a lower region 78 of the valve cap 68, an intake opening 80 is provided for the first gas exchange valve 18. The first gas exchange valve 18 is received substantially without play in the intake opening 80 and is supported in the first movement direction 22 on the valve cap 68. The valve cap 68 additionally has a continuous flange 84 spaced apart from its lower region 78 and its upper region 82 between its lower region 78 and its upper region 82. The flange 84 engages with the collar 62, in which, when the valve bridge 42 is operated by means of the first rocker arm 32 in the movement direction 22, the valve cap 68 is supported with its flange 84 on the collar 62 of the first valve operating region 46. Once the assembled unit 74 has been mounted, the fixing element 72 of the first embodiment prevents the valve cap 68 from falling out of the through opening 56 of the valve bridge 42 in which the valve cap 68 is supported on the fixing element 72 via its flange 84.

On the end of its upper region 82 when viewed in the movement direction 28, the valve cap 68 additionally has a ring region 86 protruding from the upper region 82 when viewed in the peripheral direction 58. The ring region 86 and the end of the upper region 82 form a brake rocker arm operating region 88. The brake rocker arm 70 (second rocker arm) engages with the brake rocker arm operating region 88. The ring region 86 is only selected to be so large that the valve cap 68 can be inserted through the through opening 56 of the first valve operating region 46, such that the flange 84 of the valve cap 68 comes to abut on the collar 62 on the first valve operating region 46 of the valve bridge 42.

The flange 84 additionally has a continuous, substantially spherical surface contour 90 on its upper region 82 of the valve cap 68. A tilt of the valve bridge 42 when the first gas exchange valve 18 is operated exclusively can thus be balanced out or carried out by means of the second rocker arm 70 such that the flange 84 is still acted upon by an at least continuous, linear contact of the collar 62. The valve cap 68 is designed rotationally symmetrically.

Figure 10:
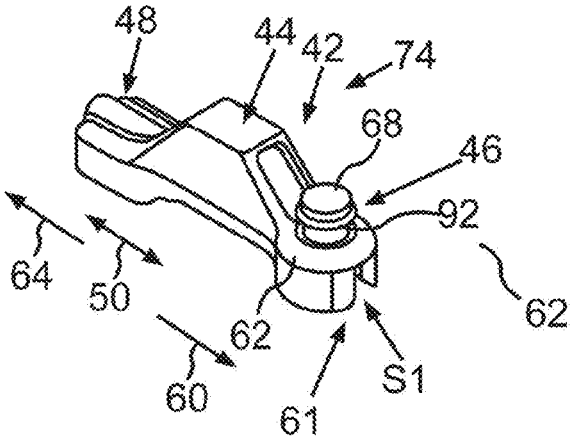
FIG. 10 shows a schematic perspective view of a second embodiment of the valve bridge.
Figure 11:
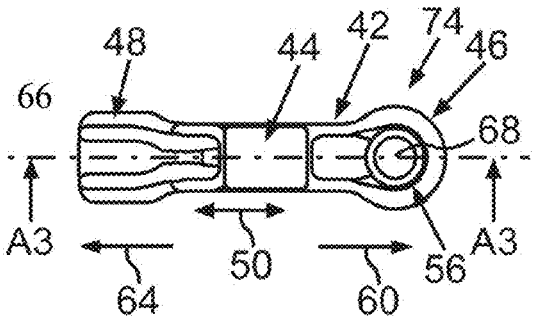
FIG. 11 shows a schematic aerial view of the valve bridge according to FIG. 10.

As an alternative to the first embodiment, a second embodiment can be seen in FIGS. 10 to 12, in which a second fixing element 92 can be provided in place of the first fixing element 72 in the upper region 82 of the valve cap 68. The second fixing element 92 comprises the upper region 82 of the valve cap 68 and abuts on the periphery of the upper region 82. The ring region 86 prevents the second fixing element 92 from slipping from the valve cap 68. The second fixing element 92 is for example designed as an O ring, wherein the O ring is designed to be so large that the valve cap 68 cannot fall out of the through opening 56 with the mounted O ring 92, and thus forms the assembled unit 74 in the second embodiment. The second fixing element 92 can be dismounted with a suitable tool in the case of a completely mounted valve train 10.

It can be seen from FIG. 9 and FIG. 14 that the longitudinal opening 61 is covered or overlapped, in particular completely, at the open location S1 in the movement directions 22, 28 by a collar 62 of the valve bridge 42 arranged in the first longitudinal region L1. The collar 62 has an extension X1 running along the movement direction 22, 28.

Figure 2:
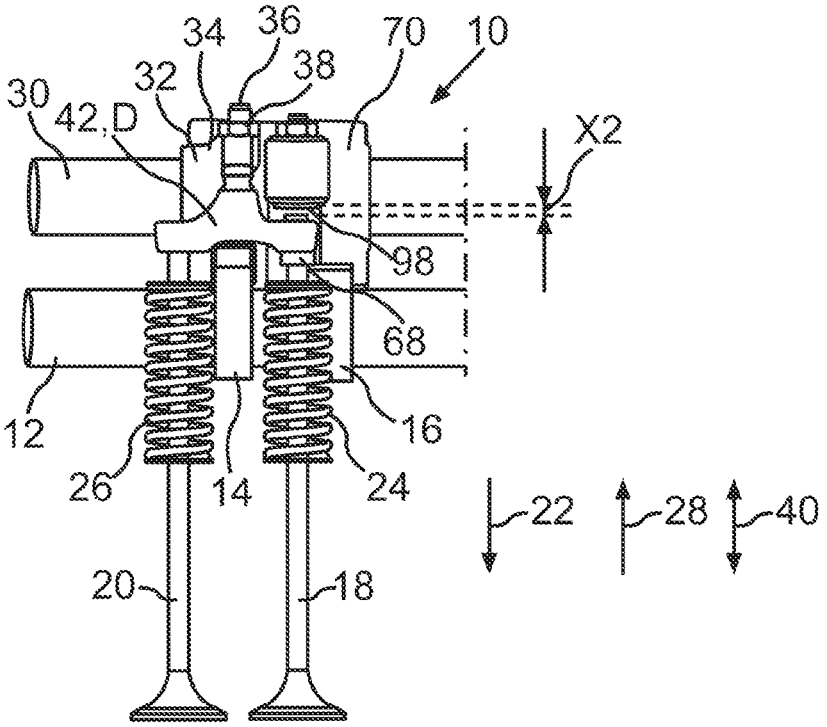
FIG. 2 shows a section of a further schematic front view of the valve train.

It can be seen from FIGS. 1 and 2 that the valve bridge 42 can be shifted in the second movement directions 28 relative to the gas exchange valves 18 and 20, relative to the valve cap 68 and relative to the rocker arms 32 and 70 into a dismounting position shown in FIG. 2 and designated D, in which, in the idle state of the rocker arms 32 and 70, the valve bridge 42 and the gas exchange valves 18 and 20, the second gas exchange valve 20 is arranged completely outside of the second valve operating region 48, in particular completely outside of the groove 63, and a spacing X2 (FIG. 2) between the second rocker arm 70 and the brake rocker arm operating region 88 of the valve cap 68 running along the movement directions 22, 28 is larger than the extension X1 (FIG. 9 and FIG. 14) of the collar 62.

Furthermore, in FIG. 7, the center of gravity of the assembled unit, also referred to as an assembly and for example comprising the fixing element 72, is designated SP.

Figure 3:
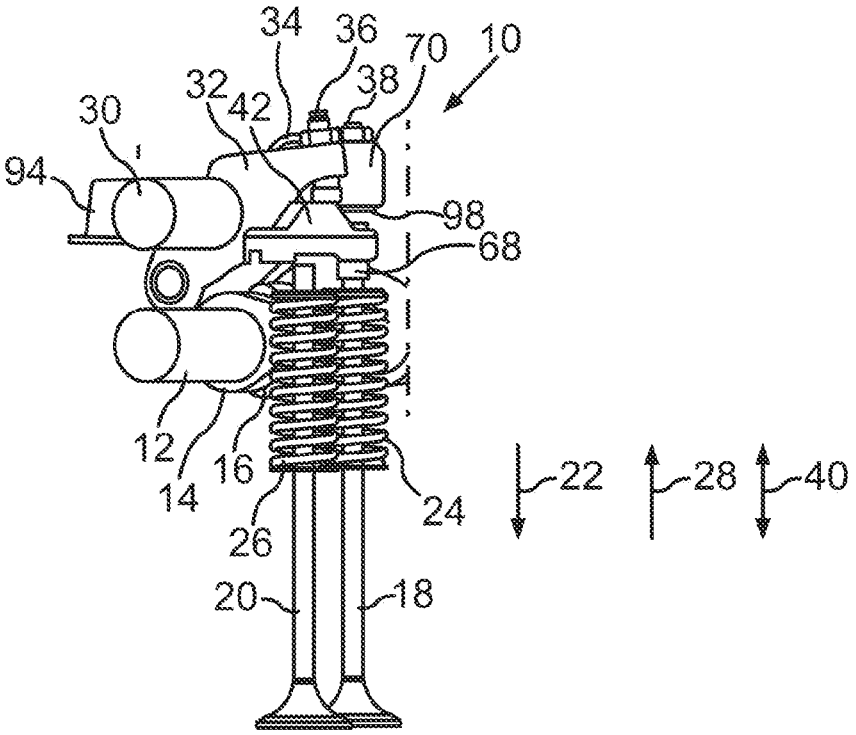
FIG. 3 shows a section of a schematic and perspective side view of the valve train.

The valve train can additionally have a spring clip 94 and a rocker arm spring 96, in particular for the brake rocker arm 70 (FIGS. 3 and 4). The rocker arm spring 96 is supported on the spring clip 94, wherein the rocker arm spring 96 acts on the second rocker arm 70 in such a manner that the second rocker arm 70 remains in contact with the second cam 16.

The brake rocker arm 70 is, for example, a hydraulic brake rocker arm. This can in particular be understood to mean the following: the brake rocker arm 70 can be hydraulically switched between a deactivated state and an activated state. In the deactivated state of the brake rocker arm 70, a piston 98 also described as a brake piston of the brake rocker arm 70 is retracted such that, despite the brake lever 70 being pivoted or operated by means of the second cam 16 of the camshaft 12, an operation of the gas exchange valve 18 caused by the brake rocker arm 70 ceases via the valve cap 68. To transfer the brake rocker arm 70 from the deactivated state into the activated state, the piston 98 is extended. The piston 98 is thus extended in the activated state of the brake rocker arm 70. If the brake rocker arm 70 is pivoted in the activated state of the brake rocker arm 70, then the first gas exchange valve 18 is operated by means of the brake rocker arm 70 via the extended piston 98 and the valve cap 68, while an operation of the second gas exchange valve 20 ceases. The spacing X2 relates in particular to a spacing running along the operating directions 22, 28 between the piston 98 and the valve operating region 46 or brake rocker arm operating region 88 of the valve cap 68.

In the following, the valve train 10 and in particular its function are described again in summary: the internal combustion engine 10 has the engine brake previously specified and also designed as a decompression brake and which is implemented via the separate second rocker arm 70 provided in addition to the first rocker arm 32 by, for example, the rocker arm 70 transferring a brake valve lift of the second cam 16 via the piston 98 to the valve cap 68, and via the latter to the gas exchange valve 18. The valve bridge 42 is designed for the fired operation, in particular the exhaust operation, such that the valve cap 68, and via the valve cap 68 the first gas exchange valve 18 can be operated independently of the valve bridge 42 or independently of the gas exchange valve 20. However, exchanging the injector 52 in a conventional manner is only possible with significant effort or is impossible, as access to the fixing 54 of the injector 52 is covered by the valve bridge 42 and is thus impossible. Thus, in conventional solutions, if the injector 52 needs to be exchanged, the valve train 10 must first be removed.

In the valve train 10, it is possible to exchange the injector 52 in a particularly simple manner. For this purpose, the adjusting element 36 (adjusting screw) is turned back or retracted, i.e., moved away from the valve bridge 42 in the movement direction 28. By means of the adjusting element 36, a play between the rocker arm 32 and the valve bridge 42, in particular the bridge operating region 44 can be adjusted, such that the adjusting element 36 can be moved along the adjustment direction 40 relative to the base body 34 of the first rocker arm 32 (exhaust rocker arm). After turning back or pushing away the adjusting element 36 from the valve bridge 42, the valve bridge 42 is raised high enough, i.e., shifted far enough in the second movement direction 28 relative to the gas exchange valves 18 and 20 that the second gas exchange valve 20 is moved out of the groove 63 completely (FIG. 2). The valve bridge 42 can now be rotated or pivoted around the valve cap 68 for example in the direction of the rocker arm axle 30 until the valve bridge 42 comes into contact or to rest on the rocker arm axle 30 or on the first rocker arm 32. Thus, as can be seen particularly clearly from FIGS. 3 and 4, the valve bridge 42 is arranged without covering the fixing 54, such that the fixing 54 is consequently easily accessible and the injector 52 can be exchanged easily, in a time- and cost-efficient manner.

In the fired operation, the rocker arm 32, also described as an exhaust rocker arm, operates an exhaust stroke movement caused by the cam 14, also described as an exhaust cam, via the adjusting element 36 and the valve bridge 42 on the two gas exchange valves 18 and 20. If the engine brake is activated, then the brake rocker arm 70 (second rocker arm) operates the first gas exchange valve 18, but not the second gas exchange valve 20, by the brake rocker arm 70 transmitting a brake lifting movement caused by the cam 16, also described as a brake cam, via the hydraulically extended piston 98 and the valve cap 68 to the first gas exchange valve 18 and, depending on the gas exchange valves 18 and 20, exclusively to the first gas exchange valve 18. As the piston 98 is retracted if the internal combustion engine is deactivated and is at a standstill, a clearance in the form of the spacing X2 results between the piston 98 and the valve cap 68, in particular its end on the brake rocker arm operating region 88. The spacing X2 thus results in particular if the second rocker arm 70 is located on the base circle of the cam 16, and is thus idle.

To reach the fixing 54 of the injector 52, the valve bridge 42 remains on the valve cap 68, and is only laterally pivoted or rotated until the valve bridge 42 comes to rest on the rocker arm axle 30. Sufficient access to the fixing 54 is thus created.

The spacing X2 (clearance) is used to remove the valve bridge 42. An excessive or complete dismounting of the valve train 10 can however also be avoided when removing the valve bridge 42.

With regard to the removal of the valve bridge 42, the counter-element 38 is first released, whereupon the adjusting element 36 is turned back completely or to the maximum, i.e., is moved away by the valve bridge 42 in the movement direction 28. In the first embodiment, the first fixing element 72 is then dismounted (FIGS. 8 and 9), and in the second embodiment, the second fixing element 92 is dismounted (FIGS. 13 and 14) to remove the hold of the valve cap 68 caused by the respective fixing element 72 and 92 on the valve bridge 42. The valve bridge 42 is then moved translationally in the second movement direction 28 relative to the gas exchange valves 18 and 20, and in particular relative to the valve cap 68, i.e., lifted, until the valve bridge 42 comes into contact with or to rest on the adjusting element 36 and until the gas exchange valve 20, in particular its end, is arranged completely outside of the groove 63. The valve bridge 42 is then tilted such that the valve bridge 42, in particular its end having the collar 62 that is arranged on the valve operating region 46, can be extended laterally with the collar 62 between the second rocker arm 70 having its piston 98 and the brake rocker arm operating region 88 of the valve cap 68, as the extension X1 is smaller than the spacing X2. The longitudinal opening 61 of the open location S1 preferably extends in the peripheral direction 58 until the valve bridge 42 can be retracted from the valve cap 68, as the valve cap 68 remains on the first gas exchange valve 18. The open locations S1 and S2 are arranged diametrically or at least substantially diametrically to one another along the longitudinal extension direction 50 of the valve bridge 42. It can in particular be seen from the Fig. that the valve operating regions 46 and 48 are arranged on respective ends of the valve bridge 42 that are spaced apart or opposite each other along the longitudinal extension direction 50 of the valve bridge 42.

A further advantage of the valve train 10 is that when mounting the valve train 10, only one component in the form of the assembled unit 74 is set on the two ends of the gas exchange valves 18 and 20. In other words, the valve cap 68, the first fixing element 72 or the second fixing element 92 and the valve bridge 42 are mounted simultaneously, such that the valve cap 68 does not first have to be set on the gas exchange valve 18 and the valve bridge 42 does not then have to be set on the valve cap 68 previously set on the first gas exchange valve 18.

It is additionally preferably provided that the center of gravity SP of the assembled unit comprising the valve bridge 42 and the valve cap 68 and preferably the fixing element 72 lies, in particular in the center, between the two gas exchange valves 18 and 20. A tilt of the valve bridge 42 caused by inertial forces and an imbalanced valve movement of the gas exchange valves 18 and 20 in the fired operation can thus be avoided or at least kept low.

In the engine braking operation, a support of the valve bridge 42 can be shifted by opening the first gas exchange valve 18 used for the engine brake, which can lead to a lateral tilt with each brake lift. To avoid an excessive edge loading, for example of the valve bridge 42 and/or of the valve cap 68 here, at least the force application surfaces of the valve cap 68 (flange 84) are designed with the spherical surface contour 90 already previously described.

As, moreover, the groove 63 is open along its peripheral direction at the exactly one location S2, and is otherwise closed, the groove 63 is a half-open groove. The valve bridge 42 can thus be used as a uniform valve bridge across different engine displacement classes. A degree of freedom with regard to a spacing between the gas exchange valves 18 and 20 in particular along the second opening direction 64 can be created by the half-open groove 63. In other words, the gas exchange valves 18 and 20 can in particular be arranged along the second opening direction 64 at different spacings from one another.

LIST OF REFERENCE CHARACTERS

10 valve train
12 camshaft
14 first cam
16 second cam

18 first gas exchange valve
20 second gas exchange valve
22 first movement direction
24 spring
26 spring
28 second movement direction
30 rocker arm axle
32 first rocker arm
34 base body
36 adjusting element
38 counter-element
40 adjustment direction
42 valve bridge
44 bridge operating region
46 first valve operating region
48 second valve operating region
50 longitudinal extension direction
52 injector
54 fixing
56 through opening
58 peripheral direction
60 first opening direction
61 longitudinal opening
62 collar
63 groove
64 second opening direction
66 groove opening
68 valve cap
70 second rocker arm
72 first fixing element
74 assembled unit
76 groove
78 lower region
80 intake opening
82 upper region
84 flange
86 ring region
88 brake rocker arm operating region
90 surface contour
92 second fixing element
94 spring clip
96 rocker arm spring
98 piston
D dismounting position
L1 first longitudinal region
L2 second longitudinal region
S1 first location
S2 second location
SP center of gravity
X1 extension
X2 spacing

The invention claimed is:

1. A valve bridge for a valve train of an internal combustion engine, comprising:

a bridge operating region via which the valve bridge is configured to be operated by a first rocker arm of the valve train and is movable translationally in a first operating direction;

a first valve operating region via which a first gas exchange valve of the internal combustion engine is configured to be operated by the valve bridge by operating the valve bridge; and a second valve operating region via which a second gas exchange valve of the internal combustion engine is configured to be operated by the valve bridge by operating the valve bridge, wherein the first valve operating region has:

a through opening that is continuous along the first operating direction, a first longitudinal region in which the through opening is completely continuously closed in its peripheral direction, and a second longitudinal region which is directly connected to the first longitudinal region in the first operating direction and in which the through opening is open along its peripheral direction at a first location in a first opening direction running perpendicular to the first operating direction, and wherein the first valve operating region is configured to receive, via the through opening, a valve cap that is held therein independent of the first gas exchange valve by a contour of the valve cap contacting the first valve operating region within the through opening, wherein the valve cap is separate from the first gas exchange valve and the second exchange valve, from the first rocker arm, and from the valve bridge and via which the first gas exchange valve is configured to be operated by a second rocker arm of the valve train, wherein the first location is covered in a second operating direction opposite to the first operating direction by a collar of the valve bridge arranged in the first longitudinal region, wherein the collar has an extension running along the first operating direction, and wherein the valve bridge is configured to be shifted in the second operating direction opposite to the first operating direction relative to the first gas exchange valve, the second gas exchange valve, the valve cap, and the first rocker arm and the second rocker arm into a dismounting position in which, in an idle state of the first rocker arm and the second rocker arm and the first gas exchange valve and the second gas exchange valve:

the second gas exchange valve is arranged completely outside of the second valve operating region; and a spacing running along the first operating direction between the second rocker are and the valve cap remaining on the first gas exchange valve when shifting the valve bridge is larger than the extension of the collar.

2. The valve bridge of claim 1, wherein the second valve operating region has a groove that is open at a location in a second opening direction running perpendicular to the first operating direction.

3. The valve bridge of claim 2, wherein the groove is completely closed in a second operating direction opposite to the first operating direction.

4. The valve bridge of claim 1, wherein the valve bridge is one part.

5. A valve train for an internal combustion engine, comprising:

a first gas exchange valve;

a second gas exchange valve;

a first rocker arm; and a valve bridge shared by the first gas exchange valve and the second exchange valve via which the first gas exchange valve and the second exchange valve is configured to be operated by the first rocker arm and is configured to be moved translationally in a first operating direction, wherein the valve bridge has:

a bridge operating region via which the valve bridge is configured to be operated by the first rocker arm and is movable translationally in the first operating direction;

a first valve operating region via which the first gas exchange valve is configured to be operated by the valve bridge by operating the valve bridge; and a second valve operating region via which the second gas exchange valve is configured to be operated by the valve bridge by operating the valve bridge, wherein the first valve operating region has:

a through opening that is continuous along the first operating direction;

a first longitudinal region in which the through opening is completely continuously closed in its peripheral direction; and a second longitudinal region which is directly connected to the first longitudinal region in the first operating direction and in which the through opening is open along its peripheral direction at a first location in a first opening direction running perpendicular to the first operating direction, wherein the first valve operating region is configured to receive, via the through opening, a valve cap that is held therein independent of the first gas exchange valve by a contour of the valve cap contacting the first valve operating region within the through opening, wherein the valve cap is separate from the first gas exchange valve and the second exchange valve, from the first rocker arm, and from the valve bridge and via which the first gas exchange valve is configured to be operated by a second rocker arm of the valve train, wherein the first location is covered in a second operating direction opposite to the first operating direction by a collar of the valve bridge arranged in the first longitudinal region, wherein the collar has an extension running along the first operating direction, and wherein the valve bridge is configured to be shifted in the second operating direction opposite to the first operating direction relative to the first gas exchange valve, the second gas exchange valve, the valve cap, and the first rocker arm and the second rocker arm into a dismounting position in which, in an idle state of the first rocker arm and the second rocker arm and the first gas exchange valve and the second gas exchange valve:

the second gas exchange valve is arranged completely outside of the second valve operating region; and a spacing running along the first operating direction between the second rocker arm and the valve cap remaining on the first gas exchange valve when shifting the valve bridge is larger than the extension of the collar.

6. The valve train of claim 5, wherein the valve cap passes through the first longitudinal region and the second longitudinal region along the first operating direction.

7. The valve train of claim 5, wherein the valve bridge and the valve cap form an assembled unit which is configured to be mounted as a whole, in which the valve cap is held on the valve bridge independently of the first gas exchange valve and the second gas exchange valve and independently of the first rocker arm and the second rocker arm.

8. An internal combustion engine for a motor vehicle, comprising:

the valve train of claim 5.

* * * * *